US011639619B2

(12) United States Patent
Han et al.

(10) Patent No.: US 11,639,619 B2
(45) Date of Patent: May 2, 2023

(54) VEHICLE DOOR HANDLE ASSEMBLY

(71) Applicants: Hyundai Motor Company, Seoul (KR); Kia Corporation, Seoul (KR)

(72) Inventors: Jung Ho Han, Seoul (KR); Jin Woo Nam, Seoul (KR); Kyoung Taek Kwak, Yongin-si (KR); Dong Jun Kim, Bucheon-si (KR); Do Won Sung, Suwon-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 52 days.

(21) Appl. No.: 17/324,842

(22) Filed: May 19, 2021

(65) Prior Publication Data

US 2022/0065003 A1 Mar. 3, 2022

(30) Foreign Application Priority Data

Aug. 28, 2020 (KR) ..... 10-2020-0109665

(51) Int. Cl.
*E05B 77/06* (2014.01)
*E05B 85/10* (2014.01)

(52) U.S. Cl.
CPC ..... *E05B 77/06* (2013.01); *E05B 85/103* (2013.01); *E05B 85/107* (2013.01)

(58) Field of Classification Search
CPC ..... E05B 77/06; E05B 77/04; E05B 85/107; Y10T 292/57; B60J 5/04
See application file for complete search history.

(56) References Cited

FOREIGN PATENT DOCUMENTS

WO WO-2020153695 A1 * 7/2020 ..... B60J 5/0415

* cited by examiner

*Primary Examiner* — Kristina R Fulton
*Assistant Examiner* — Thomas L Neubauer
(74) *Attorney, Agent, or Firm* — Morgan, Lewis & Bockius LLP

(57) ABSTRACT

A vehicle door handle assembly may include a handle housing disposed inside a door panel; a slider slidably mounted in the handle housing to be movable between a first position and a second position of the handle housing; a handle member pivotally connected to the slider through a connecting arm, and configured of being movable between a rest position and an actuating position with respect to the door panel; and an inertia locking mechanism including a blocking lever pivotally mounted to the handle housing, and a weight mounted on the blocking lever, wherein the inertia locking mechanism may prevent the handle member from moving to the actuating position by an unwanted force caused by the collision/impact of the vehicle.

18 Claims, 14 Drawing Sheets

VEHICLE DOOR HANDLE ASSEMBLY

CROSS-REFERENCE TO RELATED APPLICATION

The present application claims priority to Korean Patent Application No. 10-2020-0109665, filed on Aug. 28, 2020, in the Korean Intellectual Property Office, the entire contents of which is incorporated herein for all purposes by this reference.

BACKGROUND OF THE INVENTION

Field of the Invention

The present invention relates to a vehicle door handle assembly, and more particularly, to a vehicle door handle assembly capable of reliably preventing the unwanted actuation of a handle member caused by an unwanted force in the event of a vehicle impact/collision.

Description of Related Art

A vehicle has various doors such as side doors and a back door. Each vehicle door has a vehicle door handle for opening and closing the vehicle door, and the vehicle door handle is operatively connected to a door latch mechanism. The vehicle door handle is configured to move between a rest position and an actuating position. When the vehicle door handle is in the rest position, the door latch mechanism may keep the vehicle door closed, and when the vehicle door handle is in the actuating position, the vehicle door may be allowed to open.

In the event of a vehicle impact/collision, an unwanted force such as inertial force caused by impact load or acceleration may be applied to the vehicle door handle, and the vehicle door handle may be inadvertently moved to the actuating position, allowing the vehicle door to open and exposing occupants to a greater risk of being expelled from the vehicle.

To deal with this problem, the vehicle door handle may be provided with a blocking mechanism configured for preventing the vehicle door handle from being inadvertently moved to the actuating position when the unwanted force as in the vehicle impact/collision is applied to the vehicle door handle.

Meanwhile, the inertia direction of the vehicle door handle during an actual vehicle impact/collision may be inconsistent and vary, and thus the existing blocking mechanism may easily lose its function.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing a vehicle door handle assembly configured for reliably preventing the unwanted actuation of a handle member caused by an unwanted force in the event of a vehicle impact/collision.

According to various aspects of the present invention, a vehicle door handle assembly may include: a handle housing disposed inside a door panel; a slider slidably mounted in the handle housing to be movable between a first position and a second position of the handle housing; a handle member pivotally connected to the slider through a connecting arm, and configured of being movable between a rest position and an actuating position with respect to the door panel; and an inertia locking mechanism including a blocking lever pivotally mounted to the handle housing, and a weight mounted on the blocking lever, wherein the inertia locking mechanism may prevent the handle member from moving to the actuating position by an unwanted force caused by the collision/impact of the vehicle.

The slider may move to the first position when the handle member moves to the rest position, and the slider may move to the second position when the handle member moves to the actuating position.

The blocking lever may move between a blocking position in which the slider is blocked from moving to the second position and an unblocking position in which the slider is allowed to move to the second position.

The handle housing may include a guide slot, the slider may include a guide pin slidably engaged in and guided along the guide slot, and the guide slot may have a rest-side end portion and an actuating-side end portion provided at first and second end portions of the guide slot.

The guide pin may be positioned in the rest-side end portion when the slider is in the first position, and the guide pin may be positioned in the actuating-side end portion when the slider is in the second position.

The blocking lever may block the guide slot when the blocking lever is in the blocking position thereof.

The blocking lever may have a blocking surface which is formed on an opposite side of the weight, and the guide pin may be stopped by the blocking surface when the blocking lever is rotated to be in the blocking position.

The blocking lever may be biased to the unblocking position by a first biasing member.

The handle housing may have a locking projection, the inertia locking mechanism may have a locking member movably connected to the blocking lever, and the locking member may be releasably engaged with the locking projection.

The locking member may have a locking recess configured to be releasably engaged with the locking projection and a protrusion protruding toward the guide slot.

The locking member may move between an advanced position in which the protrusion is advanced from the blocking lever and a retracted position in which the protrusion is retracted toward the blocking lever.

The locking member may be biased to the advanced position by a second biasing member.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
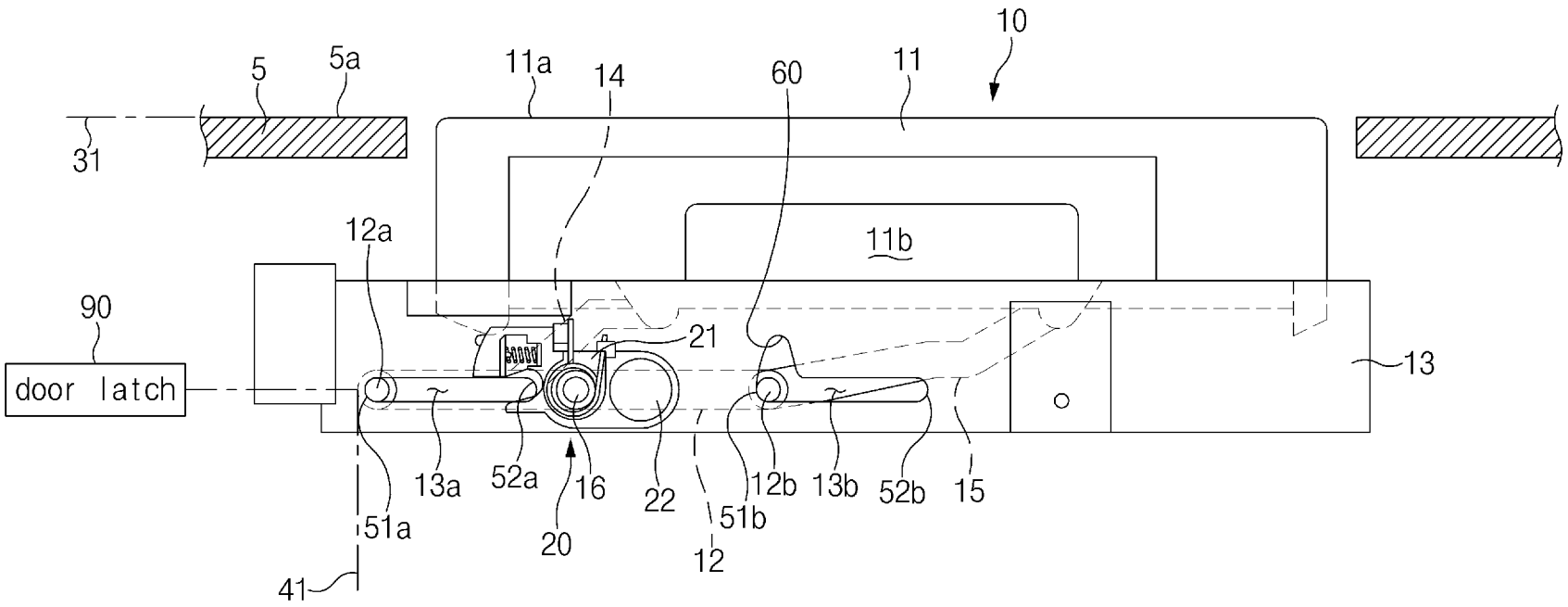
FIG. 1 illustrates a vehicle door handle assembly according to various exemplary embodiments of the present invention, in a state in which a handle member is in a rest position.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, various exemplary embodiments of the present invention will be described in detail with reference to the accompanying drawings. In the drawings, the same reference numerals will be used throughout to designate the same or equivalent elements. Furthermore, a detailed description of well-known techniques associated with the present invention will be ruled out in order not to unnecessarily obscure the gist of the present invention.

Terms such as first, second, A, B, (a), and (b) may be used to describe the elements in exemplary embodiments of the present invention. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which various exemplary embodiments of the present invention belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

Referring to FIG. 1, a vehicle door handle assembly according to various exemplary embodiments of the present invention may include a handle member 11 mounted to be movable between a rest position 31 and an actuating position 32 with respect to a door panel 5 of a vehicle door, and an inertia locking mechanism 20 preventing the handle member 11 from moving to the actuating position 32 in the event of a vehicle impact/collision.

The handle member 11 may be movably mounted in an opening or opened cavity of the door panel 5. The handle member 11 may have a grip opening 11*b* allowing a user to grip, and the user may move the handle member 11 between the rest position 31 (see FIG. 1) and the actuating position 32 (see FIG. 4).

As illustrated in FIG. 1, the rest position 31 refers to a position in which the handle member 11 is completely received inside the door panel 5. As an external surface 11*a* of the handle member 11 lies substantially flush with an external surface 5*a* of the door panel 5, the handle member 11 may not be externally exposed of the door panel 5.

Figure 4:
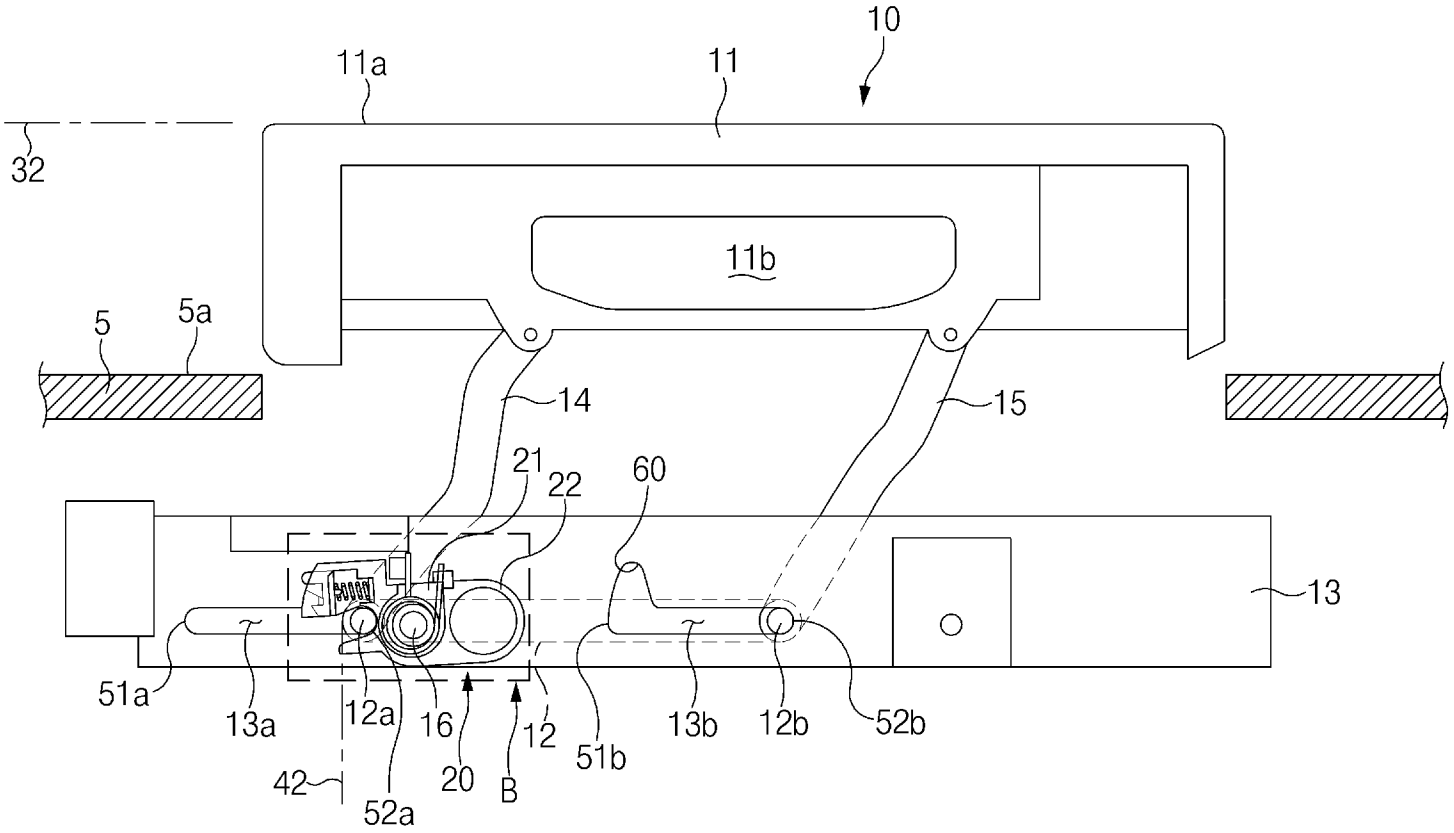
FIG. 4 illustrates a state in which the handle member illustrated in FIG. 1 is in an actuating position.

As illustrated in FIG. 4, the actuating position 32 refers to a position in which the handle member 11 is fully deployed from the door panel 5, and the external surface 11*a* of the handle member 11 may protrude outwardly from the door panel 5.

The handle member 11 may be biased toward the rest position 31 by a biasing mechanism, and the biasing mechanism may include a spring and the like. When a force is not applied to the handle member 11, the handle member 11 may be biased toward the rest position 31 by the biasing mechanism. As the user pulls the handle member 11 from the door panel 5 toward the exterior of the vehicle, the handle member 11 may move to the actuating position 32.

The handle member 11 may be movably connected to a handle housing 13, and the handle housing 13 may be disposed inside the door panel 5. For example, the handle housing 13 may be detachably coupled to the inside of the door panel 5. As various exemplary embodiments of the present invention, the handle housing 13 may be one-piece construction with the inside of the door panel 5. The handle housing 13 may have an internal space in which at least a portion of the handle member 11 is received.

A slider 12 may be movably mounted in the internal space of the handle housing 13. The slider 12 may be mounted to be movable between a first position 41 and a second position 42 within the handle housing 13, and the handle member 11 may be connected to the slider 12 through one or more connecting arms 14 and 15. As the handle member 11 moves to the rest position 31, the slider 12 may move to the first position 41, and as the handle member 11 moves to the actuating position 32, the slider 12 may move to the second position 42.

The slider 12 may have one or more guide pins 12*a* and 12*b*, and the handle housing 13 may have one or more guide slots 13*a* and 13*b*. The guide pins 12*a* and 12*b* of the slider 12 may be guided along the guide slots 13*a* and 13*b* of the handle housing 13.

According to various exemplary embodiments of the present invention, the slider 12 may have a first guide pin 12*a* and a second guide pin 12*b* spaced from each other. The first guide pin 12*a* and the second guide pin 12*b* may be provided at both end portions of the slider 12, respectively. The handle housing 13 may have a first guide slot 13*a* and a second guide slot 13*b* spaced from each other. The first guide pin 12*a* of the slider 12 may be guided along the first guide slot 13*a* of the handle housing 13, and the second guide pin 12*b* of the slider 12 may be guided along the second guide slot 13*b* of the handle housing 13. A first connecting arm 14 and a second connecting arm 15 may connect the handle member 11 and the slider 12. External-side end portions of the connecting arms 14 and 15 may be pivotally connected to the handle member 11, and internal-side end portions of the connecting arms 14 and 15 may be pivotally connected to the guide pins 12*a* and 12*b* of the slider 12, respectively.

The first guide slot 13*a* may have a first rest-side end portion 51*a* and a first actuating-side end portion 52*a* provided at both end portions thereof, and the second guide slot 13*b* may have a second rest-side end portion 51*b* and a second actuating-side end portion 52*b* provided at first and second end portions of the guide slot. When the handle member 11 is in the rest position 31 and the slider 12 is in the first position 41, the guide pins 12*a* and 12*b* may be positioned in the rest-side end portions 51*a* and 51*b* of the guide slots 13*a* and 13*b*, respectively. When the handle member 11 is in the actuating position 32 and the slider 12 is in the second position 42, the guide pins 12*a* and 12*b* may be positioned in the actuating-side end portions 52*a* and 52*b* of the guide slots 13*a* and 13*b*, respectively.

The vehicle door handle assembly 10 may be operatively connected to a door latch mechanism 90. When the handle member 11 is in the rest position 31, the door latch mechanism 90 may keep the vehicle door closed. That is, when the handle member 11 is in the rest position 31, the vehicle door may be locked by the lock operation of the door latch mechanism 90. When the handle member 11 is in the actuating position 32, the vehicle door may be allowed to open. That is, when the handle member 11 is in the actuating position 32, the vehicle door may be unlocked by the unlock operation of the door latch mechanism 90.

According to various exemplary embodiments of the present invention, the slider 12 may be operatively connected to the door latch mechanism 90 through a cable or the like. As the handle member 11 moves to the rest position 31, the slider 12 may move to the first position 41, and thus the closing of the vehicle door may be maintained by the lock operation of the door latch mechanism 90. As the handle member 11 moves to the actuating position 32, the slider 12 may move to the second position 42, and thus the vehicle door may be allowed to open by the unlock operation of the door latch mechanism 90.

The inertia locking mechanism 20 may prevent the handle member 11 of the vehicle door handle assembly 10 from inadvertently actuating when an unwanted force greater than a predetermined force acts on the vehicle door handle assembly 10 during the vehicle impact/collision. For example, the unwanted force may be inertial force caused by impact load or acceleration during the vehicle impact/collision.

According to various exemplary embodiments of the present invention, the inertia locking mechanism 20 may prevent the handle member 11 from moving to the actuating position 32 in the event of the vehicle impact/collision. The inertia locking mechanism 20 may include a blocking lever 21 pivotally mounted to the handle housing 13 through a pivot pin 16, and a weight 22 provided on the blocking lever 21.

The blocking lever 21 may block at least one guide pin of the two guide pins 12*a* and 12*b* from moving to the corresponding actuating-side end portion. According to various exemplary embodiments of the present invention, the blocking lever 21 may block the first guide pin 12*a* from moving to the first actuating-side end portion 52*a*.

According to various exemplary embodiments of the present invention, the blocking lever 21 may have a pivot boss 23 in which the pivot pin 16 is received. As the blocking lever 21 rotates around the pivot pin 16, the blocking lever 21 may move between a blocking position (see FIG. 9 and FIG. 10) in which the slider 12 is blocked from moving to the second position 42 and an unblocking position (see FIG. 1, FIG. 2, FIG. 3, FIG. 4, and FIG. 5) in which the slider 12 is allowed to move to the second position 42.

The blocking lever 21 may have a first portion 21*a* and a second portion 21*b* opposite each other in relation to the pivot boss 23. The first portion 21*a* may extend from the pivot boss 23 toward the first guide pin 12*a*, and the second portion 21*b* may extend from the pivot boss 23 toward the second guide pin 12*b*. The first portion 21*a* may have a blocking surface 24 facing the first guide slot 13*a* and the first guide pin 12*a*. The first portion 21*a* may have a guide surface 53 aligned with the first guide slot 13*a* and a slot 54 connected to the guide surface 53. The guide surface 53 may be flat, and the slot 54 may be inclined with respect to the guide surface 53 at a predetermined angle. The weight 22 may be fixed to the second portion 21*b* so that the center of gravity of the blocking lever 21 may be biased from the center portion of the pivot pin 16 or the pivot boss 23 toward the second portion 21*b*, and accordingly the blocking lever 21 may be rotated by the inertia of the weight 22. The guide surface 53 and the slot 54 may be located below the blocking surface 24, and the weight 22 may be on the opposite side of the blocking surface 24, the guide surface 53, and the slot 54.

Figure 9:
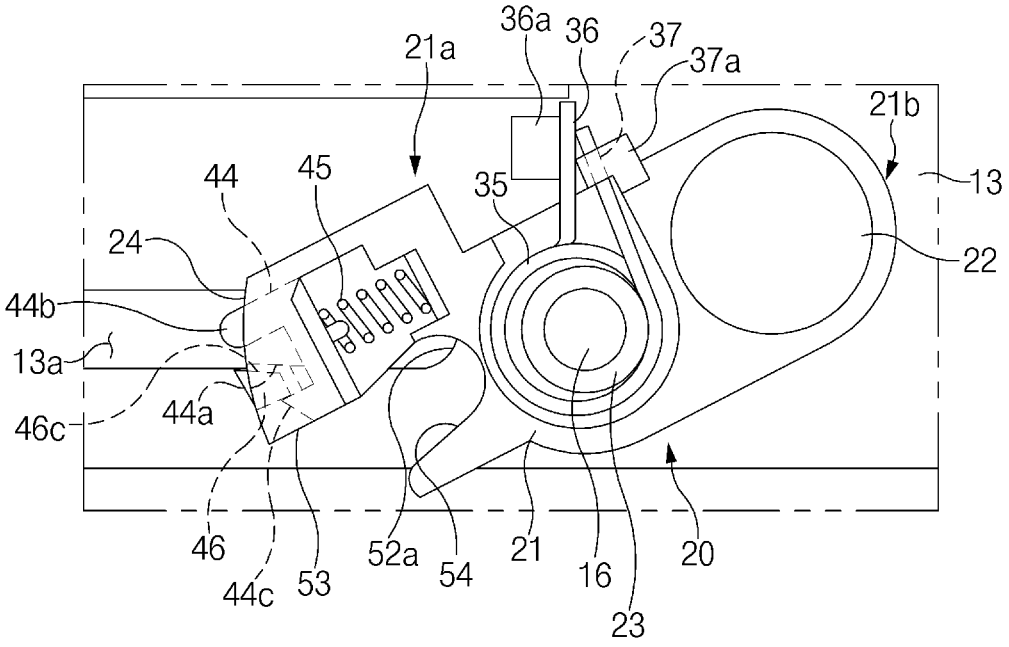
FIG. 9 illustrates a state in which a blocking lever of an inertia locking mechanism is locked in a blocking position in a vehicle door handle assembly according to various exemplary embodiments of the present invention.
Figure 10:
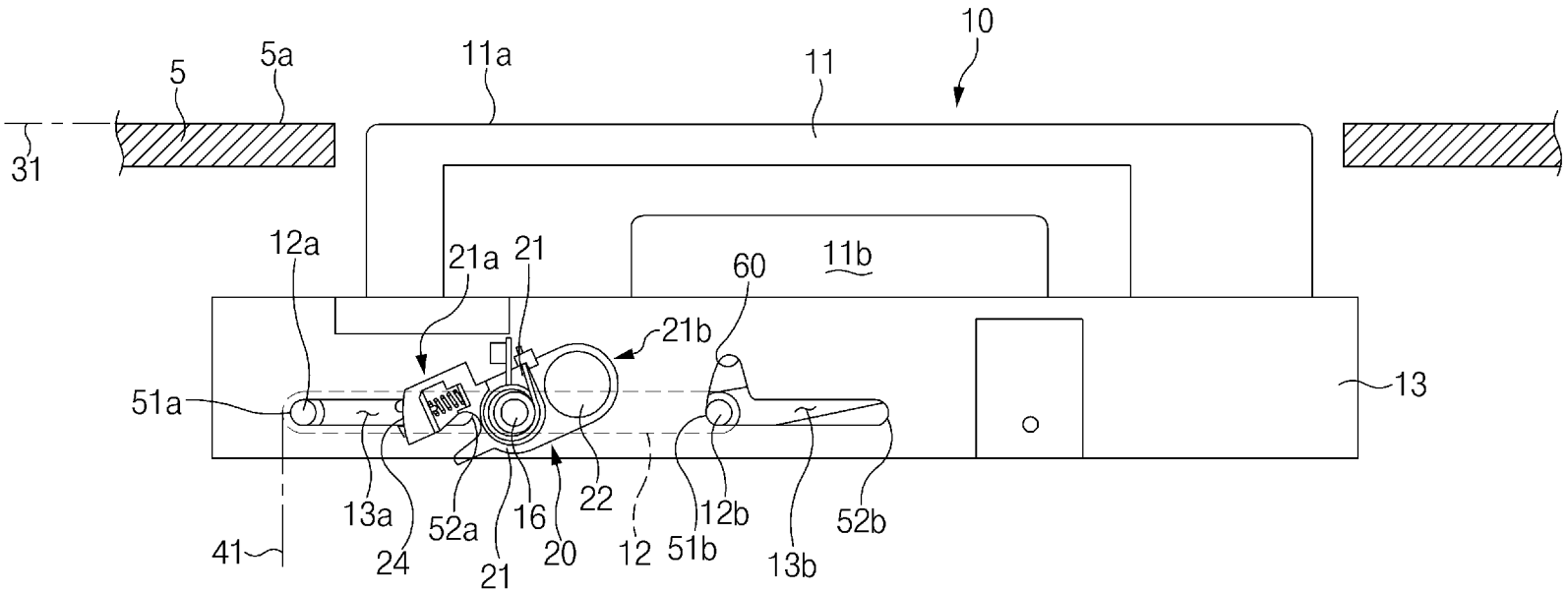
FIG. 10 illustrates a state of a handle member which is prevented from moving to an actuating position in a state in which the blocking lever of the inertia locking mechanism illustrated in FIG. 9 has been locked in the blocking position.

Referring to FIG. 9 and FIG. 10, when the blocking lever 21 is in the blocking position, the first portion 21*a* of the blocking lever 21 may overlap a portion of the first guide slot 13*a* adjacent to the first actuating-side end portion 52*a* so that the blocking lever 21 may block the portion of the first guide slot 13*a* adjacent to the first actuating-side end portion 52*a*. Accordingly, the first guide pin 12*a* may be stopped by the blocking surface 24 of the blocking lever 21 in the middle of moving to the first actuating-side end portion 52*a*, and thus the first guide pin 12*a* may fail to move to the first actuating-side end portion 52*a*. Since the slider 12 is blocked from moving to the second position 42, the handle member 11 may be prevented from moving to the actuating position 32.

Referring to FIG. 1, FIG. 2, FIG. 3, FIG. 4, and FIG. 5, when the blocking lever 21 is in the unblocking position, the guide surface 53 and the slot 54 of the blocking lever 21 may be aligned with the first guide slot 13*a* so that the blocking lever 21 may not block the first guide slot 13*a*. When the first guide pin 12*a* moves to the first actuating-side end portion 52*a*, the first guide pin 12*a* may be allowed to move to the first actuating-side end portion 52*a* without being interfered with the blocking surface 24 of the blocking lever 21, and thus the slider 12 may move to the second position 42.

The blocking lever 21 may be biased toward the unblocking position (see FIG. 1, FIG. 2, FIG. 3, FIG. 4, and FIG. 5) by a first biasing member 35, and the first biasing member 35 may be disposed around the pivot boss 23. The first biasing member 35 may have a first elastic leg 36 and a second elastic leg 37. The first elastic leg 36 may be supported to the handle housing 13 through a first support 36*a*, and the second elastic leg 37 may be supported to the blocking lever 21 through a second support 37*a*. The first support 36*a* may be provided on the handle housing 13, and the second support 37*a* may be provided on the blocking lever 21.

The handle housing 13 may have a locking projection 46, and the locking projection 46 may be located below the first guide slot 13*a*. A locking member 44 may be movably connected to the blocking lever 21, and the locking member 44 may have a locking recess 44*a* releasably engaged with the locking projection 46 and a protrusion 44*b* protruding toward the first guide slot 13*a*. Referring to FIG. 9 and FIG. 10, as the blocking lever 21 moves to the blocking position, the locking recess 44*a* of the locking member 44 may engage with the locking projection 46, and thus the blocking lever 21 may be locked in the blocking position. That is, in the event of the collision of the vehicle, the blocking lever 21 may be held in the blocking position by the engagement between the locking recess 44*a* of the locking member 44 and the locking projection 46, and accordingly the first guide pin 12*a* may be stopped by the blocking surface 24 of the blocking lever 21 so that the first guide pin 12*a* may be blocked from moving to the first actuating-side end portion 52*a* of the first guide slot 13*a*. Thus, the slider 12 may be blocked from moving to the second position 42, and the handle member 11 may be prevented from moving to the actuating position 32.

Figure 13:
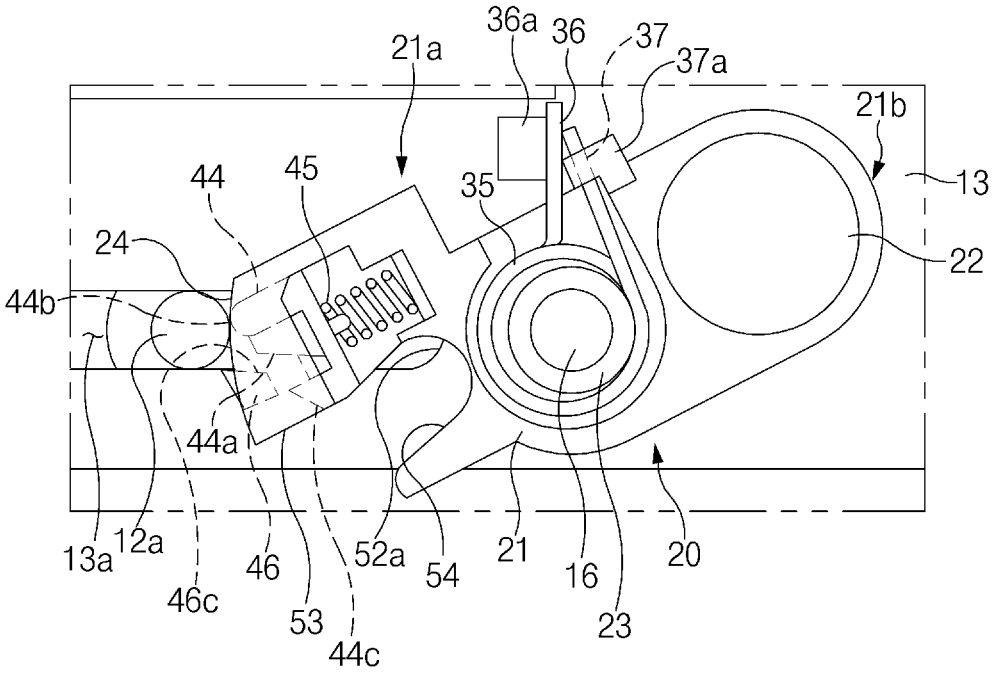
FIG. 13 illustrates a state in which the first guide pin illustrated in FIG. 12 presses the protrusion of the locking member, and the locking member is disengaged from a locking projection.

The locking member 44 may move between an advanced position (see FIGS. 3, 5, 7, and 14) in which the protrusion 44*b* is advanced from the blocking lever 21 and a retracted position (see FIGS. 8 and 13) in which the protrusion 44*b* is retracted toward the blocking lever 21. The locking member 44 may be biased toward the advanced position by a second biasing member 45. The second biasing member 45 may be a coil spring disposed between the locking member 44 and the first portion 21*a* of the blocking lever 21. As illustrated in FIG. 13, the first guide pin 12*a* may press the protrusion 44*b* of the locking member 44 and the second biasing member 45 may be compressed, and thus the locking member 44 may move to the retracted position.

The locking member 44 may have a lower inclined surface 44*c* provided on the bottom end portion thereof, and the locking projection 46 may have an inclined surface 46*c* corresponding to the lower inclined surface 44*c* of the locking member 44. As the lower inclined surface 44*c* of the locking member 44 moves along the inclined surface 46*c* of the locking projection 46, the locking member 44 may be engaged with or disengaged from the locking projection 46.

Referring to FIG. 1, when the handle member 11 is in the rest position 31, at least a portion of the handle member 11 and the first and second connecting arms 14 and 15 may be folded into the handle housing 13, and the slider 12 may be in the first position 41.

Figure 2:
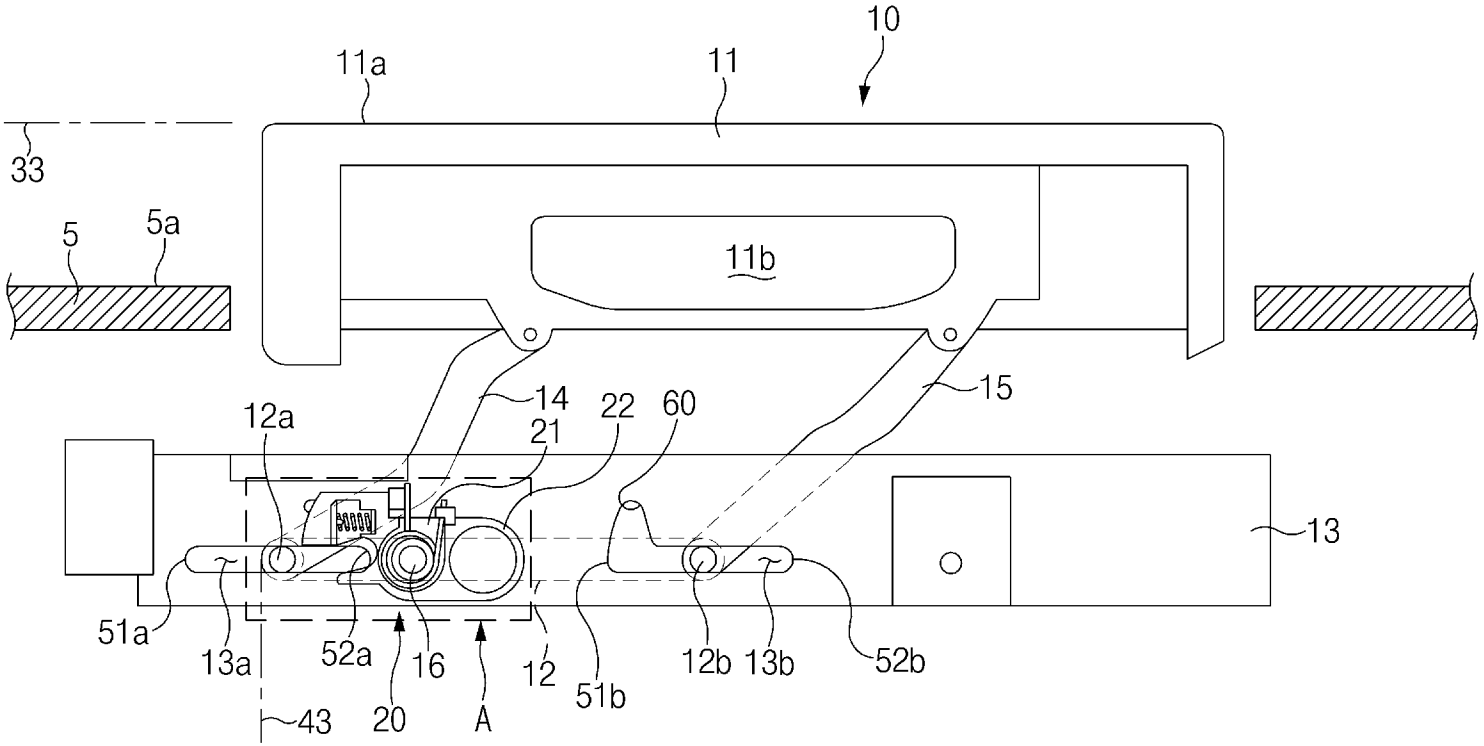
FIG. 2 illustrates a state in which the handle member illustrated in FIG. 1 is in a partially deployed position.
Figure 3:
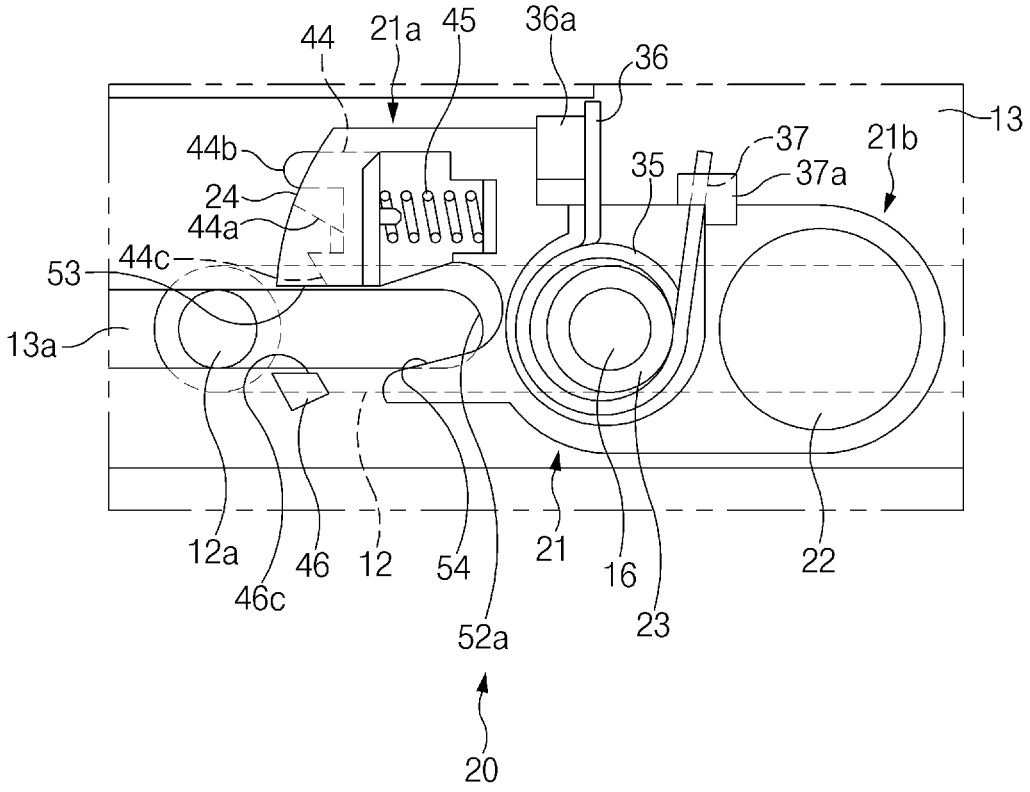
FIG. 3 illustrates an enlarged view of portion A of FIG. 2.

Referring to FIG. 2, when the handle member 11 moves to the actuating position 32, the handle member 11 may move to a partially deployed position 33 in which the handle member 11 is partially deployed from the door panel 5. The first and second connecting arms 14 and 15 may be unfolded from the handle housing 13, and the slider 12 may be in a middle position 43.

Figure 5:
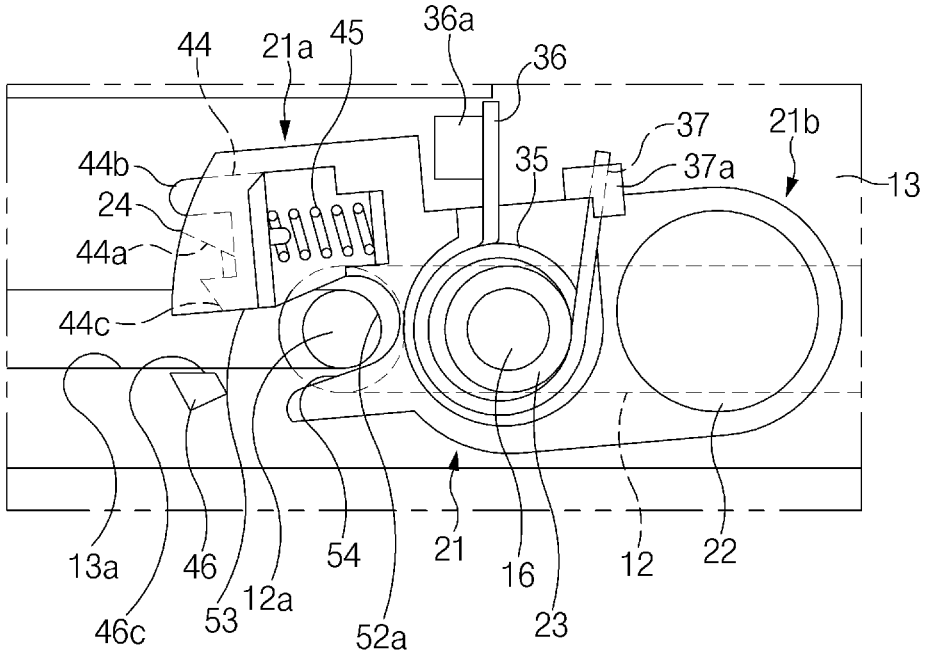
FIG. 5 illustrates an enlarged view of portion B of FIG. 4.

Referring to FIG. 4, when the handle member 11 is in the actuating position 32 in which the handle member 11 is fully deployed from the door panel 5, the first and second connecting arms 14 and 15 may be fully unfolded from the handle housing 13, and the slider 12 may be in the second position 42. As illustrated in FIG. 5, the first guide pin 12*a* may be positioned in the slot 54 of the blocking lever 21, and thus the first guide pin 12*a* may be held by the blocking lever 21 even if the blocking lever 21 slightly pivots.

Figure 6:
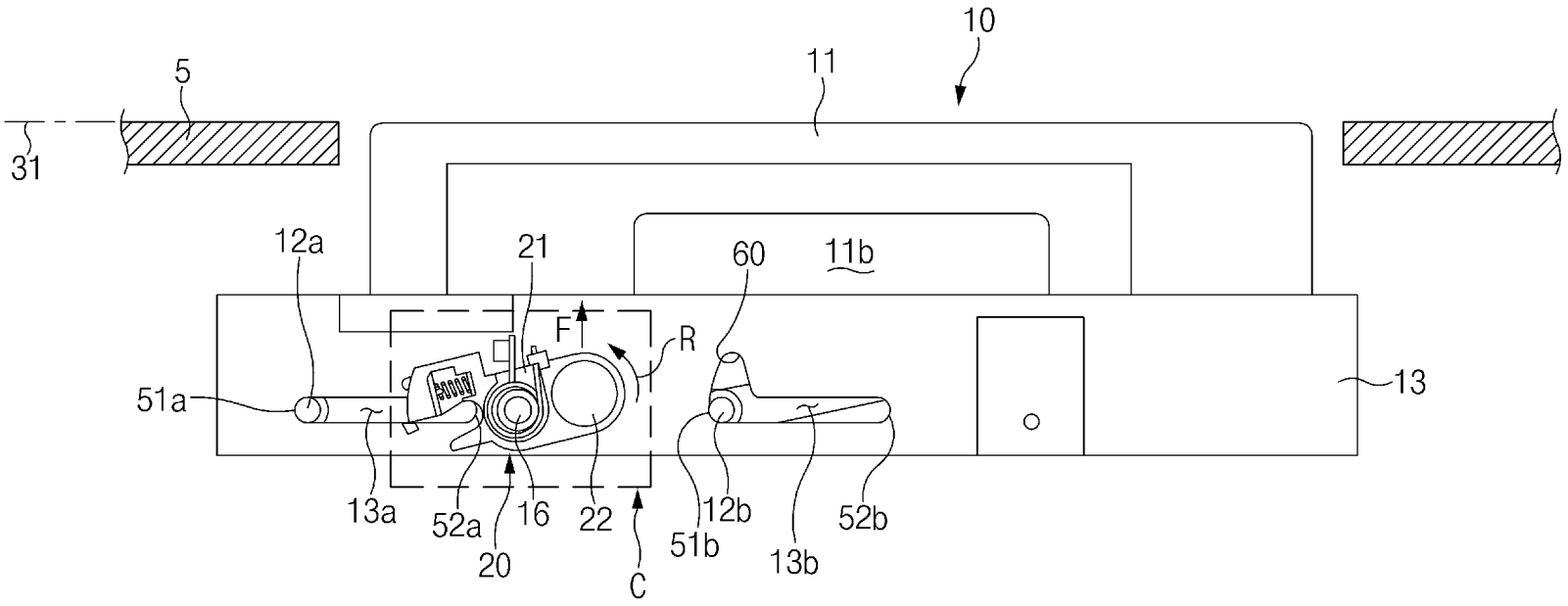
FIG. 6 illustrates a vehicle door handle assembly according to various exemplary embodiments of the present invention, in a state in which a blocking lever of an inertia locking mechanism rotates to a blocking position in the event of a vehicle impact/collision.
Figure 7:
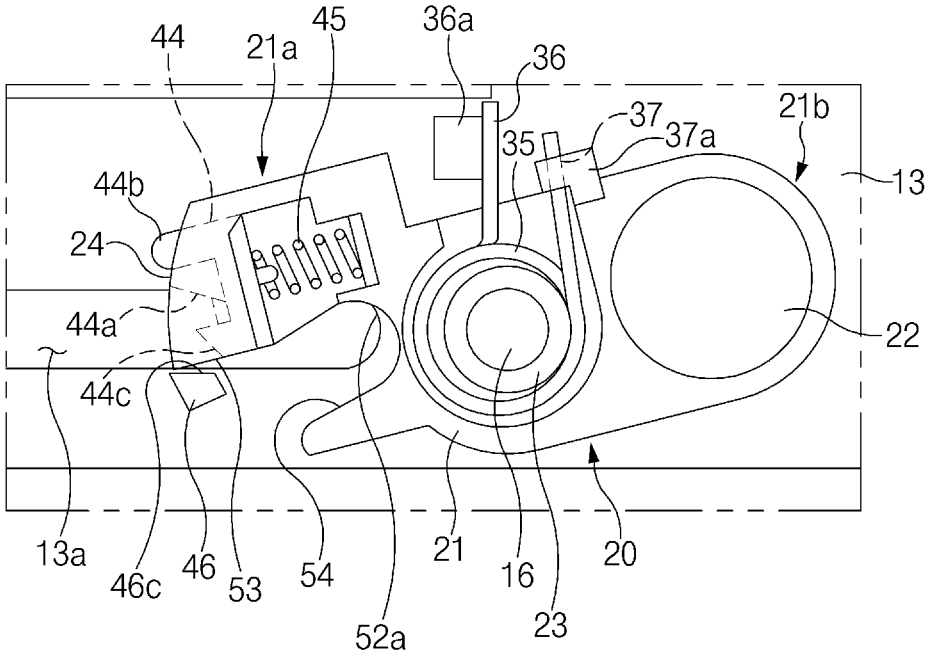
FIG. 7 illustrates an enlarged view of portion C of FIG. 6.
Figure 8:
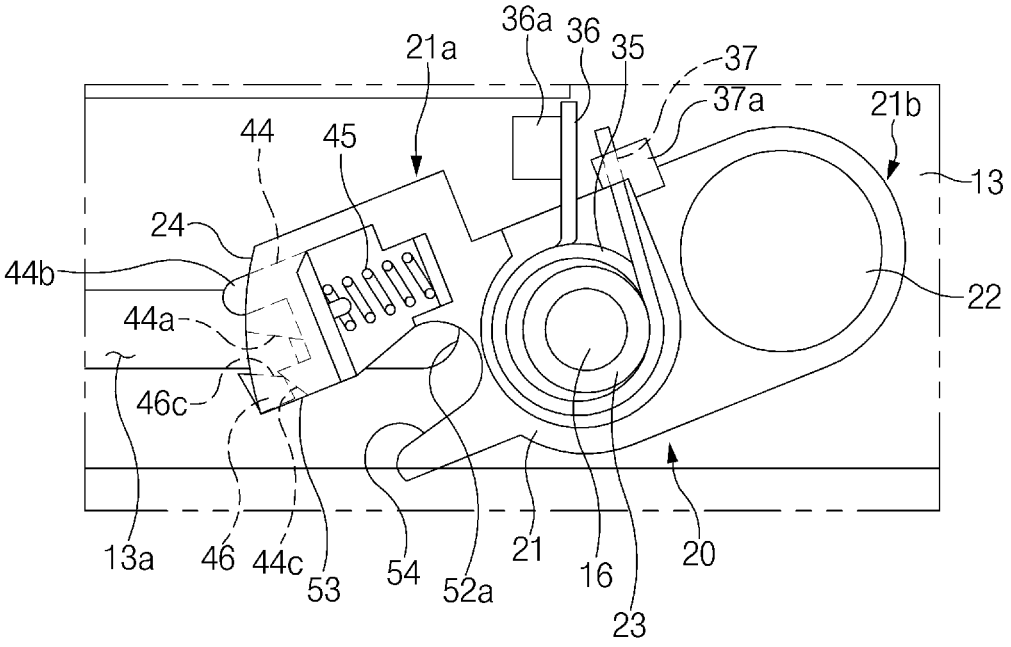
FIG. 8 illustrates a state in which a blocking lever of an inertia locking mechanism moves to a blocking position in a vehicle door handle assembly according to various exemplary embodiments of the present invention.

Referring to FIGS. 6 to 8, in a state in which the handle member 11 is in the rest position 31, when an unwanted force greater than the predetermined force acts on the vehicle door handle assembly 10 in the event of a vehicle impact/collision, the blocking lever 21 may rotate in a direction indicated by arrow R due to the inertia of the weight 22 (for example, 30 G), and accordingly, the blocking lever 21 may move to the blocking position in which the first guide slot 13*a* is blocked. The lower inclined surface 44 of the locking member 44 may move down along the inclined surface 46*c* of the locking projection 46, and the locking member 44 may move to the retracted position.

Accordingly, as illustrated in FIG. 9 and FIG. 10, the locking recess 44*a* of the locking member 44 may engage with the locking projection 46, and thus the blocking lever 21 may be locked in the blocking position.

Figure 11:
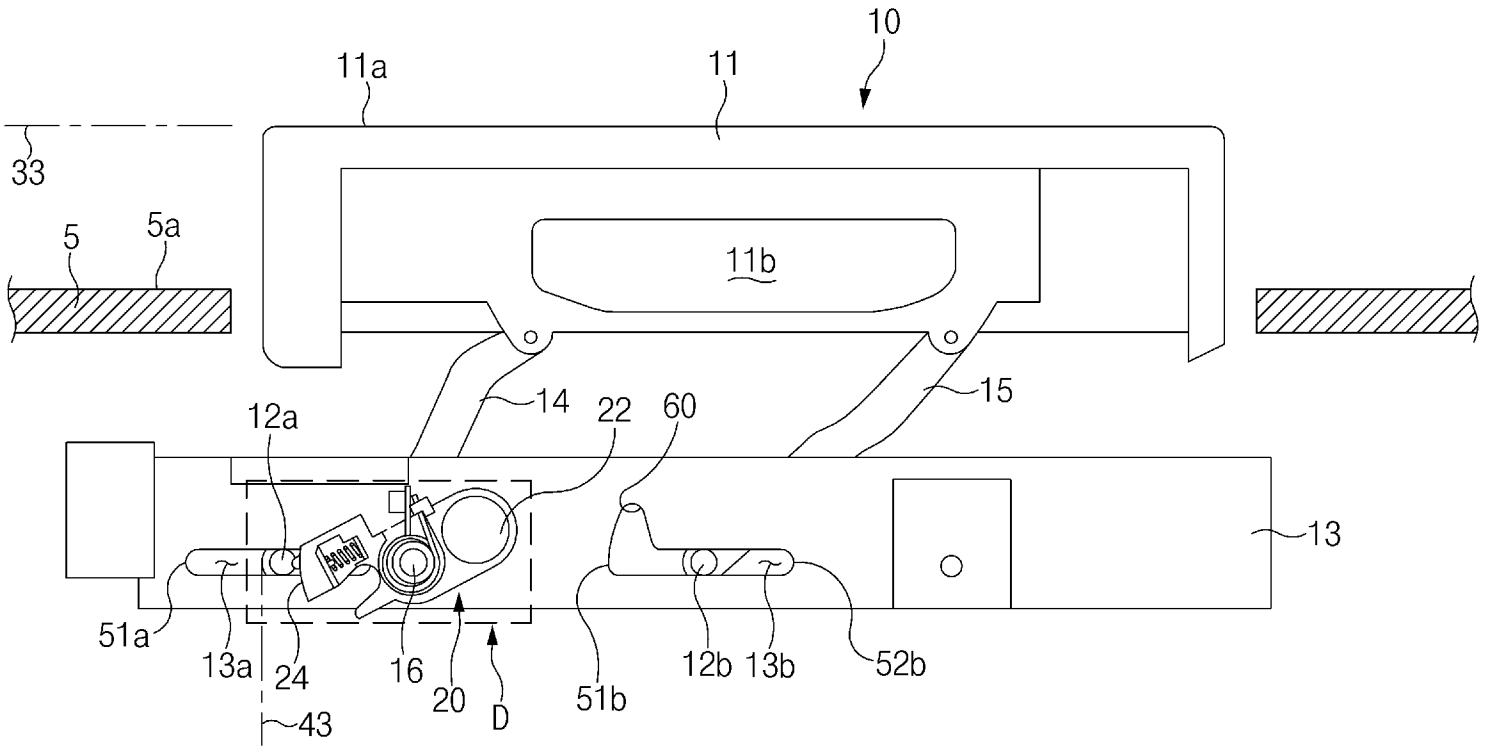
FIG. 11 illustrates a vehicle door handle assembly according to various exemplary embodiments of the present invention, in a state in which a first guide pin moves to a protrusion of a locking member when a handle member is in a partially deployed position.
Figure 12:
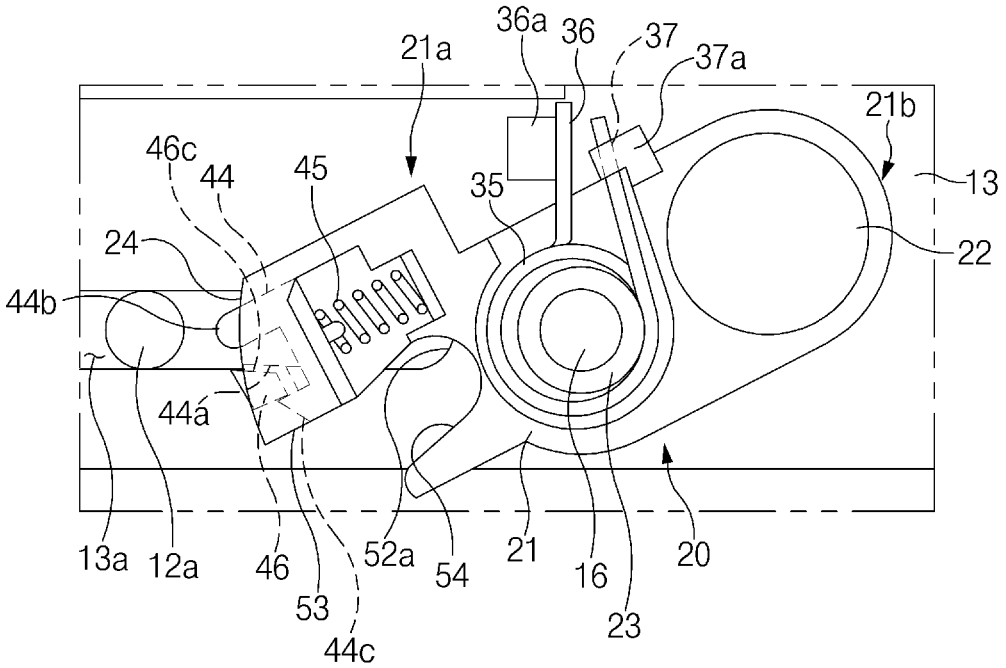
FIG. 12 illustrates an enlarged view of portion D of FIG. 11.
Figure 14:
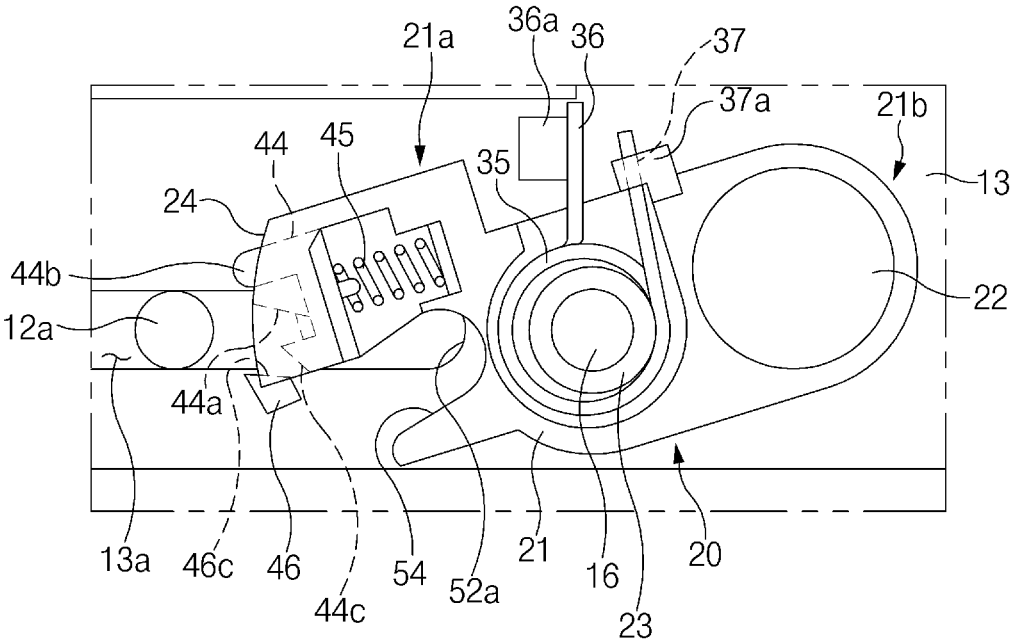
FIG. 14 illustrates a state in which the blocking lever illustrated in FIG. 13 moves to an unblocking position by a first biasing member.

When the user pulls the handle member 11 toward the exterior of the door panel 5 after the blocking lever 21 has been locked in the blocking position, the handle member 11 may be in the partially deployed position 33 and the slider 12 may be in the middle position 43 as illustrated in FIG. 11, and accordingly, the first guide pin 12*a* may press the protrusion 44*b* of the locking member 44 and the locking member 44 may move to the retracted position as illustrated in FIG. 12, and FIG. 13. As a result, the locking recess 44*a* of the locking member 44 may be disengaged from the locking projection 46. As the locking recess 44*a* of the locking member 44 is disengaged from the locking projection 46, the locking of the blocking lever 21 may be released. Accordingly, after the blocking lever 21 moves toward the unblocking position by the first biasing member 35 as illustrated in FIG. 14, the blocking lever 21 may return to the unblocking position as illustrated in FIG. 1.

As set forth above, according to exemplary embodiments of the present invention, when the unwanted force caused by the collision of the vehicle is applied, the blocking lever 21 may move to the blocking position so that the handle member 11 may be prevented from moving to the actuating position. The blocking lever 21 may be held in the blocking position by the engagement of the locking member 44 and the locking projection 46, and thus the unwanted actuation of the handle member 11 may be prevented.

As the user pulls the handle member 11 toward the exterior of the vehicle after the collision of the vehicle, the locking member 44 may be disengaged from the locking projection 46 and the blocking lever 21 may return to the unblocking position. Thus, the vehicle door may be opened smoothly after the collision of the vehicle so that the driver and occupants may be safely rescued.

In an exemplary embodiment of the present invention, the handle housing 13 includes a locking groove 60 formed at an end of the second guide slot 13*b*. When an unwanted force in the event of a vehicle impact/collision is applied to the vehicle door handle assembly 10, the second guide pin 12*b* of the slider 12 may rotate outwardly in pivoting with respect to the first guide pin 12*a* of the slider 12 by the inertia of the slider 12. However, since the locking groove 60 is formed on the second guide slot 13*b*, the second guide pin 12*b* may be locked into the locking groove 60 to prevent the handle member 11 from pivotally moving toward the actuating position.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A vehicle door handle assembly comprising:

a handle housing disposed inside a door panel;

a slider slidably mounted in the handle housing to be movable between a first position and a second position of the handle housing;

a handle member pivotally connected to the slider through a connecting arm, and configured of being movable between a rest position and an actuating position with respect to the door panel; and an inertia locking mechanism including a blocking lever pivotally mounted to the handle housing, and a weight mounted on the blocking lever, wherein the inertia locking mechanism is configured to prevents the handle member from moving to the actuating position in event of a vehicle impact, wherein the slider moves toward the first position when the handle member moves toward the rest position, and the slider moves toward the second position when the handle member moves toward the actuating position, and wherein the blocking lever moves between a blocking position in which the slider is blocked from moving to the second position and an unblocking position in which the slider is allowed to move toward the second position.

2. The vehicle door handle assembly according to claim 1, wherein the handle housing includes a guide slot, the slider includes a guide pin slidably engaged in and guided along the guide slot, and the guide slot has a rest-side end portion and an actuating-side end portion provided at first and second end portions of the guide slot.

3. The vehicle door handle assembly according to claim 2, wherein the guide pin is positioned in the rest-side end portion when the slider is in the first position, and wherein the guide pin is positioned in the actuating-side end portion when the slider is in the second position.

4. The vehicle door handle assembly according to claim 2, wherein the blocking lever blocks the guide slot when the blocking lever is in the blocking position.

5. The vehicle door handle assembly according to claim 2, wherein the blocking lever includes a blocking surface which is formed on an opposite side of the weight, and wherein the guide pin is stopped by the blocking surface when the blocking lever is rotated to be in the blocking position.

6. The vehicle door handle assembly according to claim 5, wherein the blocking lever further includes a guide surface and a slot connected to the guide surface, and the slot is formed to be inclined with respect to the guide surface at a predetermined angle, and wherein the guide surface and the slot of the blocking lever are selectively aligned with the guide slot according to rotation of the blocking lever.

7. The vehicle door handle assembly according to claim 2, wherein the handle housing has a locking projection, wherein the inertia locking mechanism further includes a locking member movably connected to the blocking lever, and wherein the locking member is configured to be releasably engaged with the locking projection by an inertia of the weight.

8. The vehicle door handle assembly according to claim 7, wherein the locking member has:

a locking recess configured to be releasably engaged with the locking projection of the handle housing; and a protrusion protruding toward the guide slot.

9. The vehicle door handle assembly according to claim 8, wherein the locking member is configured to move between an advanced position in which the protrusion is advanced from the blocking lever and a retracted position in which the protrusion is retracted toward the blocking lever.

10. The vehicle door handle assembly according to claim 9, wherein the locking member is elastically biased to the advanced position by a second biasing member mounted between the locking member and the blocking lever.

11. The vehicle door handle assembly according to claim 9, further including a door latch mechanism operatively connected to the slider.

12. The vehicle door handle assembly according to claim 1, wherein the blocking lever is elastically biased to the unblocking position by a first biasing member.

13. The vehicle door handle assembly according to claim 12, wherein the first biasing member is elastically connected to the blocking lever and the handle housing.

14. The vehicle door handle assembly according to claim 1, wherein the connecting arm is in plural to include a first connecting arm pivotally connected to a first portion of the handle member and pivotally connected to a first portion of the slider via a first pin and a second connecting arm pivotally connected to a second portion of the handle member and pivotally connected to a second portion of the slider via a second pin, wherein the guide slot is in plural to include a first guide slot into which the first pin is slidably coupled, and a second guide slot into which the second pin is slidably coupled, and wherein the blocking lever pivotally mounted to the handle housing selectively blocks a movement of the first pin in the first guide slot in event of the vehicle impact.

15. The vehicle door handle assembly according to claim 14, wherein the second guide slot includes a locking groove into which the second pin is selectively engaged when an external force larger than a predetermined force is applied to the handle member.

16. The vehicle door handle assembly according to claim 15, wherein the blocking lever further includes a guide surface and a slot connected to the guide surface, and the slot is formed to be inclined with respect to the guide surface at a predetermined angle, and wherein the guide surface and the slot of the blocking lever are selectively aligned with the first guide slot according to rotation of the blocking lever.

17. The vehicle door handle assembly according to claim 15, wherein the handle housing has a locking projection, wherein the inertia locking mechanism further includes a locking member movably connected to and elastically movable with respect to the blocking lever, and wherein the locking member is configured to be releasably engaged with the locking projection to lock the blocking lever to the handle housing by inertia of the weight.

18. The vehicle door handle assembly according to claim 14, wherein the blocking lever includes a blocking surface which is formed on an opposite side of the weight, and wherein the first guide pin is stopped by the blocking surface when the blocking lever is rotated to be in a blocking position.

* * * * *